US009062259B2

(12) United States Patent
Koseoglu et al.

(10) Patent No.: US 9,062,259 B2
(45) Date of Patent: Jun. 23, 2015

(54) OXIDATIVE DESULFURIZATION IN FLUID CATALYTIC CRACKING PROCESS

(75) Inventors: Omer Refa Koseoglu, Dhahran (SA); Abdennour Bourane, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 555 days.

(21) Appl. No.: 13/560,351

(22) Filed: Jul. 27, 2012

(65) Prior Publication Data

US 2013/0026071 A1 Jan. 31, 2013

Related U.S. Application Data

(60) Provisional application No. 61/513,062, filed on Jul. 29, 2011.

(51) Int. Cl.

| | |
|---|---|
| ***C10G 27/04*** | (2006.01) |
| ***C10G 11/18*** | (2006.01) |
| ***C10G 55/00*** | (2006.01) |
| ***C10G 27/10*** | (2006.01) |

(52) U.S. Cl.

CPC ..... *C10G 27/04* (2013.01); *C10G 11/182* (2013.01); *C10G 55/00* (2013.01); *C10G 2300/202* (2013.01); *C10G 2300/4056* (2013.01); *C10G 27/10* (2013.01); *C10G 11/18* (2013.01)

(58) Field of Classification Search

CPC ..... C10G 11/18; C10G 11/182; C10G 27/04; C10G 27/10; C10G 55/00; C10G 55/06

See application file for complete search history.

(56) References Cited

U.S. PATENT DOCUMENTS

| | | | | |
|---|---|---|---|---|
| 2,541,795 | A † | 2/1951 | Verley | |
| 3,807,090 | A | 4/1974 | Moss | |
| 3,838,039 | A | 9/1974 | Vesely et al. | |
| 3,856,870 | A | 12/1974 | Hayes | |
| 4,255,162 | A | 3/1981 | Moss | |
| 4,298,460 | A | 11/1981 | Fujimori et al. | |
| 4,316,794 | A | 2/1982 | Schoennagel | |
| 4,440,629 | A | 4/1984 | Stine | |
| 5,824,207 | A * | 10/1998 | Lyapin et al. | 208/3 |
| 6,482,315 | B1 | 11/2002 | Roberie et al. | |
| 6,635,169 | B1 | 10/2003 | Bhore et al. | |

(Continued)

FOREIGN PATENT DOCUMENTS

| | | | |
|---|---|---|---|
| EP | 2045012 | A1 | 4/2009 |
| JP | 2004195445 | A | 7/2004 |

OTHER PUBLICATIONS

PCT/US2012/048572, International Search Report and Written Opinion dated Dec. 3, 2012, 8 pages.

*Primary Examiner* — Renee E Robinson

(74) *Attorney, Agent, or Firm* — Abelman, Frayne & Schwab

(57) ABSTRACT

A process for catalytically cracking and oxidatively desulfurizing a hydrocarbon feedstock containing organosulfur compounds is provided. Oxygen containing gas is introduced with a cracking catalyst and the feed to form a suspension. At least a portion of organosulfur compounds in the hydrocarbon feedstock are oxidized to form oxidized organosulfur compounds, carbon-sulfur bonds of oxidized organosulfur compounds are cleaved to form sulfur-free hydrocarbon compounds and sulfur oxides, and oxidized and unoxidized compounds are catalytically cracked into hydrocarbon compounds of lower boiling points. Cracked components and the cracking catalyst particles are separated and recovered for regeneration and reuse.

13 Claims, 3 Drawing Sheets

(56) References Cited

U.S. PATENT DOCUMENTS

| | | | |
|---|---|---|---|
| 6,846,403 | B2 | 1/2005 | Cheng et al. |
| 6,852,214 | B1 | 2/2005 | Chester et al. |
| 6,923,903 | B2 | 8/2005 | Chester et al. |
| 7,309,416 | B2 | 12/2007 | Fokema et al. |
| 7,374,666 | B2 † | 5/2008 | Wachs |
| 7,449,104 | B2 | 11/2008 | Sughrue et al. |
| 7,491,316 | B2 | 2/2009 | Ketley et al. |
| 2003/0034275 | A1 | 2/2003 | Roberie et al. |
| 2004/0159583 | A1 | 8/2004 | Mesters et al. |
| 2007/0227951 | A1 | 10/2007 | Thirugnanasampanthar et al. |
| 2008/0172929 | A1 | 7/2008 | Ketley et al. |
| 2008/0308463 | A1 | 12/2008 | Keckler et al. |

* cited by examiner
† cited by third party

OXIDATIVE DESULFURIZATION IN FLUID CATALYTIC CRACKING PROCESS

RELATED APPLICATIONS

This application claims the benefit of U.S. Provisional Patent Application No. 61/513,062 filed Jul. 29, 2011, the disclosure of which is hereby incorporated by reference in its entirety.

BACKGROUND OF THE INVENTION

1. Field of the Invention

This invention relates to oxidative desulfurization and more particularly to a process and system for integrated oxidative desulfurization and fluid catalytic cracking of liquid hydrocarbon feedstocks.

2. Description of Related Art

In conventional oil refinery operations, various processes occur in discrete units and/or steps. This is generally due to the complexity of naturally occurring whole crude oil mixtures, and the fact that crude oil feedstocks processed at refineries often differ based on the location and age of the production well, pre-processing activities at the production well, and the means used to transport the crude oil to the refinery plant.

Two very important and conventionally separate refining processes include desulfurization to reduce the organosulfur compounds present and fluidized catalytic cracking (FCC) for converting heavy hydrocarbon, including gasoils and residues into lighter hydrocarbon fractions.

Desulfurization is a vital step in refining hydrocarbons into transportation and heating fuel. The discharge into the atmosphere of sulfur compounds during processing and end-use of the petroleum products derived from sulfur-containing sour crude oil poses health and environmental problems. Stringent reduced-sulfur specifications applicable to transportation and other fuel products have impacted the refining industry, and it is necessary for refiners to make capital investments to greatly reduce the sulfur content in gas oils to 10 parts per million by weight (ppmw) or less. In the industrialized nations such as the United States, Japan and the countries of the European Union, refineries have already been required to produce environmentally clean transportation fuels. For instance, in 2007 the United States Environmental Protection Agency required the sulfur content of highway diesel fuel to be reduced 97%, from 500 ppmw (low sulfur diesel) to 15 ppmw (ultra-low sulfur diesel). The European Union has enacted even more stringent standards, requiring diesel and gasoline fuels sold in 2009 to contain less than 10 ppmw of sulfur. Other countries are following in the footsteps of the United States and the European Union and are moving forward with regulations that will require refineries to produce transportation fuels with ultra-low sulfur levels.

To keep pace with recent trends toward production of ultra-low sulfur fuels, refiners must choose among the processes or crude oils that provide flexibility that ensures future specifications are met with minimum additional capital investment, in many instances by utilizing existing equipment. Conventional technologies such as hydrocracking and two-stage hydrotreating offer solutions to refiners for the production of clean transportation fuels. These technologies are available and can be applied as new grassroots production facilities are constructed. However, many existing hydroprocessing facilities, such as those using relatively low pressure hydrotreaters, represent a substantial prior investment and were constructed before these more stringent sulfur reduction requirements were enacted.

With the increasing prevalence of more stringent environmental sulfur specifications in transportation fuels mentioned above, the maximum allowable sulfur levels are being reduced to no greater than 15 ppmw, and in some cases no greater than 10 ppmw. This ultra-low level of sulfur in the end product typically requires either construction of new high pressure hydrotreating units, or a substantial retrofitting of existing facilities, e.g., by incorporating gas purification systems, reengineering the internal configuration and components of reactors, and/or deployment of more active catalyst compositions.

Sulfur-containing compounds that are typically present in hydrocarbon fuels include aliphatic molecules such as sulfides, disulfides and mercaptans as well as aromatic molecules such as thiophene, benzothiophene and its long chain alkylated derivatives, and dibenzothiophene and its alkyl derivatives such as 4,6-dimethyl-dibenzothiophene.

Aliphatic sulfur-containing compounds are more easily desulfurized (labile) using conventional hydrodesulfurization methods. However, certain highly branched aliphatic molecules can hinder the sulfur atom removal and are moderately more difficult to desulfurize (refractory) using conventional hydrodesulfurization methods.

Among the sulfur-containing aromatic compounds, thiophenes and benzothiophenes are relatively easy to hydrodesulfurize. The addition of alkyl groups to the ring compounds increases the difficulty of hydrodesulfurization. Dibenzothiophenes resulting from addition of another ring to the benzothiophene family are even more difficult to desulfurize, and the difficulty varies greatly according to their alkyl substitution, with di-beta substitution being the most difficult to desulfurize, thus justifying their "refractory" appellation. These beta substituents hinder exposure of the heteroatom to the active site on the catalyst.

Conventional hydrodesulfurization processes can be used to remove a major portion of the sulfur from petroleum distillates for the blending of refinery transportation fuels. However, most hydrodesulfurization processing units cannot be operated efficiently for removal of sulfur from compounds where the sulfur atom is sterically hindered as in multi-ring aromatic sulfur compounds. This is especially true where the sulfur heteroatom is hindered by two alkyl groups (e.g., 4,6-dimethyldibenzothiophene). These hindered dibenzothiophenes predominate at low sulfur levels such as 50 to 100 ppm. Severe operating conditions, including higher hydrogen partial pressure, higher temperature, and higher catalyst volume, are conventionally applied to remove the sulfur from these sterically hindered compounds. The increase of hydrogen partial pressure can only be done by increasing the recycle gas purity, or by design and construction of new grassroots hydrodesulfurization units, which is a very costly option. Furthermore, the use of severe operating conditions results in yield loss, reduced catalyst cycle time and product quality deterioration.

The economical removal of refractory sulfur-containing compounds is therefore exceedingly difficult to achieve, and accordingly removal of sulfur-containing compounds in hydrocarbon fuels to an ultra-low sulfur level is very costly by current hydrotreating techniques. When previous regulations permitted sulfur levels up to 500 ppmw, there was little need or incentive to desulfurize beyond the capabilities of conventional hydrodesulfurization, and hence the refractory sulfur-containing compounds were not targeted. However, in order to meet the more stringent sulfur specifications, these refractory sulfur-containing compounds must be substantially removed from hydrocarbon fuels streams.

The development of alternative desulfurization routes has been widely studied and applied with varying degree of success, including the oxidative route where sulfur-containing compounds are oxidized. In oxidative desulfurization processes, sulfur-containing hydrocarbon compounds are converted to their respective oxides, i.e., sulfoxides and/or sulfones. The oxidized sulfur compounds are subsequently removed typically by extraction or adsorption.

Oxidative desulfurization of residual hydrocarbons boiling above 370° C. is a developing technology, and there remains little literature teaching effective processes. This is due to the nature of heavier hydrocarbon fractions, which contain elemental sulfur above 2 weight % (W %). The organic sulfur level is much higher because sulfur is in the hydrocarbon structure, and can be above 12 W % depending upon the molecular weight of the hydrocarbons in a particular fraction. Accordingly, oxidation of organic sulfur compounds followed by separation of the oxidized compounds can result in undesirable removal of large portion of the valuable hydrocarbon component. Hydrocarbons in these separated oxidized sulfur compounds must subsequently be recovered, e.g., by breakage of the carbon-sulfur bonds, in order to increase the overall hydrocarbon yield.

Another very important and ubiquitous operation in hydrocarbon refinery operations relates to catalytic conversion. There are two basic modes for catalytic conversion of hydrocarbon feedstocks. The first mode is catalytic conversion of hydrocarbons without the addition of hydrogen to the conversion zone, which is typically conducted at temperatures in the range of from about 480° C. to about 550° C. using a circulating stream of catalyst. The second mode is the catalytic conversion of hydrocarbon feedstock with added hydrogen at reaction conversion temperatures less than about 540° C. with the reaction zone comprising a fixed bed of catalyst.

This first mode, commonly referred to as fluid catalytic cracking (FCC), has the advantage of being performed without the added expense of in influent hydrogen stream, and is conducted at relatively low pressure, i.e., about 3 kg/cm$^2$ to about 4 kg/cm$^2$ or less. However, this mode is incapable of upgrading the hydrocarbon product by hydrogenation, and requires relatively high reaction temperatures which accelerate conversion of hydrocarbons into coke thereby decreasing the potentially greater volumetric yield of the normally liquid hydrocarbon product. This coke forms on the catalyst, therefore FCC processes require catalyst regeneration to burn off the coke and allow the catalyst to be recycled.

The second mode, commonly known as fixed bed hydrocracking processes, has achieved commercial acceptance by petroleum refiners, this process has several disadvantages. In order to attempt to achieve long runs and high on-stream reliability, fixed bed hydrocrackers require a high inventory of catalyst and a relatively high pressure reaction zone which is generally operated at 150 kg/cm$^2$ or greater to achieve catalyst stability. In addition, two phase flow of reactants over a fixed bed of catalyst often creates uneven distribution within the reaction zone, resulting in inefficient utilization of catalyst and incomplete conversion of the reactants. Further, momentary misoperation or electrical power failure can cause severe catalyst coking which may require the process to be shut down for offline catalyst regeneration or replacement.

In conventional refinery operations, desulfurization and cracking of hydrocarbons are carried-out in separate unit operations, e.g., a fluid catalytic cracking unit to break the carbon-carbon bond to convert the high boiling point hydrocarbons into low boiling point hydrocarbons, and either hydrotreating to break the carbon-sulfur bond and convert sulfur into hydrogen sulfide or oxidative desulfurization processes where sulfur is oxidized into sulfoxides and/or sulfones and then removed from hydrocarbon streams.

Therefore, it would be desirable to increase the efficacy of the conventional cracking and desulfurization processes.

SUMMARY OF THE INVENTION

Accordingly, it is an object of the present invention to provide an integrated desulfurization and fluid catalytic cracking process that can be practiced without substantial addition to existing facilities of costly equipment, hardware and control systems.

In accordance with one or more embodiments, a process is provided for catalytically cracking and oxidatively desulfurizing a hydrocarbon feedstock containing organosulfur compounds to thereby recover a product stream including lower boiling hydrocarbon components and having a reduced concentration of organosulfur compounds as compared to the hydrocarbon feedstock. The process comprises the steps of:

a. combining the hydrocarbon feedstock, an effective amount of oxygen containing gas, an effective amount of heated cracking catalyst and optionally an effective amount of heterogeneous catalyst additive containing oxidation functionality to form a suspension;

b. maintaining the suspension through a reaction zone of a fluid catalytic cracking reactor apparatus to oxidize at least a portion of organosulfur compounds in the hydrocarbon feedstock to form oxidized organosulfur compounds, cleave carbon-sulfur bonds of oxidized organosulfur compounds to form sulfur-free hydrocarbon compounds and sulfur oxide, and catalytically crack oxidized and unoxidized compounds, including unoxidized sulfur-free hydrocarbon compounds, unoxidized organosulfur compounds, and oxidized organosulfur compounds, into hydrocarbon compounds of lower boiling points, wherein catalytic cracking occurs under conditions that favor catalytic cracking over thermal cracking of compounds in the hydrocarbon feedstock;

c. separating and recovering cracked components and the cracking catalyst particles;

d. regenerating at least a portion of the separated cracking catalyst particles; and e. returning at least a portion of the regenerated cracking catalyst particles with the hydrocarbon feedstock and oxygen containing gas in step (a).

In accordance with one or more additional embodiments, the above step (a) further comprises adding an effective quantity of heterogeneous catalyst additive containing oxidation functionality.

In accordance with one or more additional embodiments, an effective quantity of homogeneous catalyst additive containing oxidation functionality can be added to the feedstock upstream of step (a).

Advantageously, the present invention integrate unit operations commonly found in existing refineries, and uses them in a manner that achieves desulfurization and cracking in a combined, efficacious and efficient manner.

BRIEF DESCRIPTION OF THE DRAWINGS

The invention will be described in further detail below and with reference to the attached drawings in which.

DETAILED DESCRIPTION OF THE INVENTION

According to the process and apparatus described herein, fluid catalytic cracking (FCC) is integrated with oxidative desulfurization, referred to herein as "oxidative fluid catalytic cracking," in a manner that achieves effective and efficient desulfurization and cracking of certain hydrocarbon fractions.

The FCC process is well known and commonly used worldwide. In conventional processes, the feedstock is preheated to a temperature in the range of from about 250° C. to about 420° C. and contacted with catalyst heated to a temperature in the range of from about 650° C. to about 700° C. in the reactor or in the riser. The catalyst and the products are mechanically separated in the reactor, and any oil remaining on the catalyst is removed by steam stripping. The cracked oil vapors are then passed to a fractionation tower to fractionate into various products. The catalyst is transferred for regeneration by burning off coke deposits in the presence of air.

In the oxidative fluid cracking process and apparatus described herein, gaseous oxidant is injected to the riser together with the hydrocarbon feedstock to thereby oxidatively crack the hydrocarbon molecules. The carbon sulfur bond is cleaved after the sulfur compounds are oxidized in the fluid catalytic cracking process while the carbon-carbon bond cracking occurs.

While not wishing to be bound by theory, C—S bonds in sulfone molecules are generally weaker than C—S bonds corresponding sulfides, and thus the rate of desulfurization of sulfones can be higher.

Figure 1:
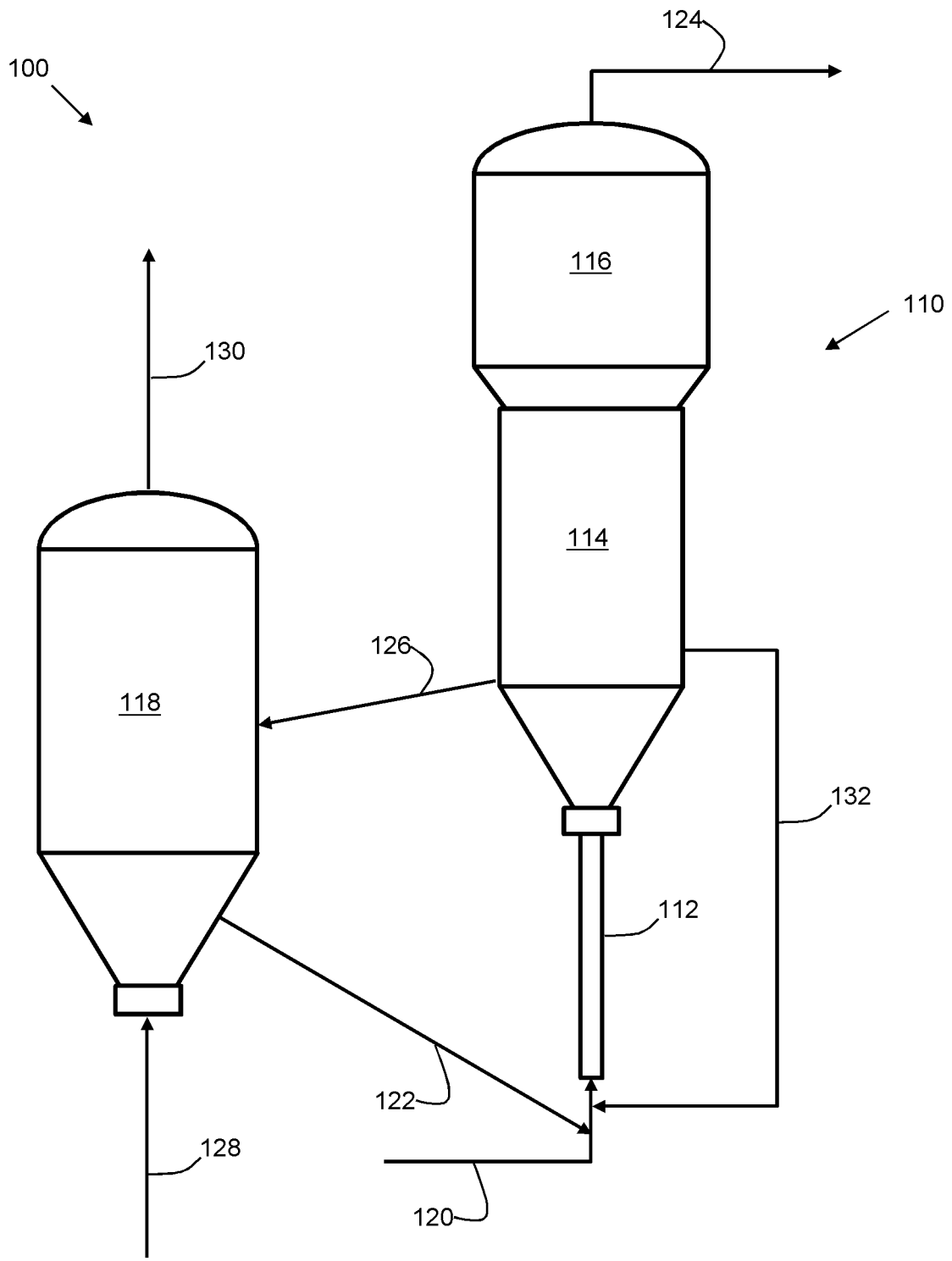
FIG. 1 is a schematic diagram of apparatus for oxidative fluid catalytic cracking.

FIG. 1 is a schematic illustration of an oxidative FCC system 100 according to the present invention, which generally includes a conventional FCC apparatus adapted for oxidative desulfurization of a hydrocarbon feedstock. System 100 generally includes a reactor 110 having a riser portion 112, a reaction zone 114 and a separation zone 116, and a regeneration vessel 118 for regenerating spent catalyst. For the purpose of the simplified schematic illustration and description, the numerous valves, temperature sensors, electronic controllers and the like that are customarily employed and are apparent to those of ordinary skill in the art are not included. Further, the construction and arrangement of a conventional FCC apparatus can vary from that shown as is apparent to those of ordinary skill in the art.

A mixture of hydrocarbon feedstock and gaseous oxidant is conveyed via a conduit 120 for admixture and intimate contact with an effective quantity of heated fresh or regenerated solid cracking catalyst particles which are conveyed via a conduit 122 from regeneration vessel 118. The feed mixture and the cracking catalyst are contacted under conditions to form a suspension that is introduced into the riser 112. In certain embodiments, an effective amount of a heterogeneous catalyst additive containing oxidation functionality is introduced along with the FCC catalyst. In alternative embodiments, or in combination with the heterogeneous catalyst, an effective amount of a homogeneous catalyst additive containing oxidation functionality is introduced along with the hydrocarbon feedstock 120.

Figure 2A:
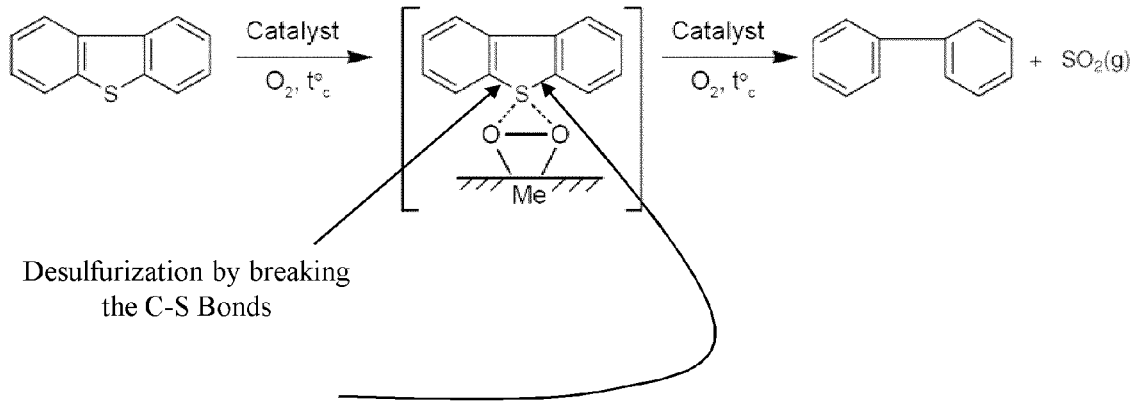
FIGS. 2A and 2B are postulated gas phase catalytic oxidative desulfurization reaction mechanisms.
Figure 2B:
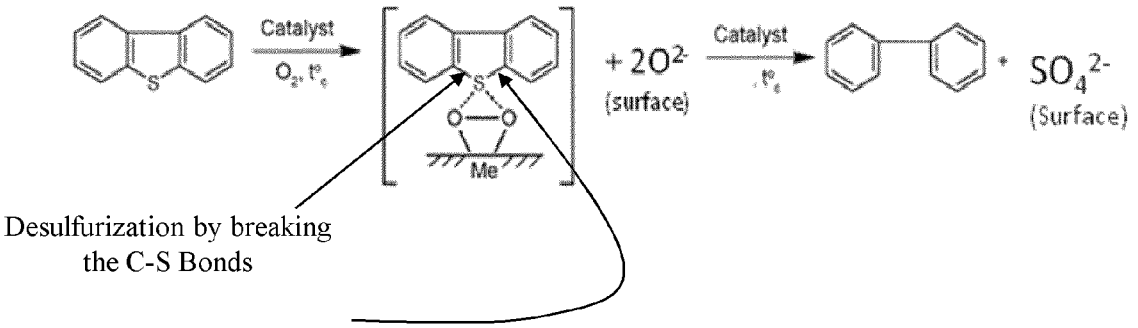
Figure 3:
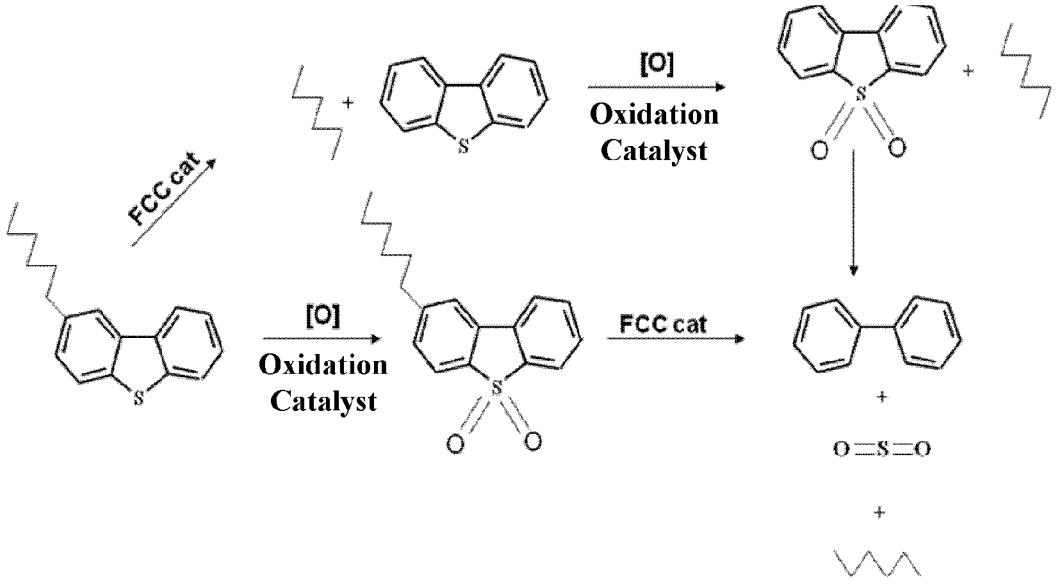
FIG. 3 is a postulated overall reaction scheme during an oxidative fluid catalytic cracking process.

In the continuous process, the mixture of cracking catalyst and hydrocarbon feedstock proceeds upward through the riser 112 into reaction zone 114 in which the temperature, pressure and residence time are controlled within ranges that are generally based on the operating characteristics of the cracking catalysts used in the process. In riser 112 and reaction zone 114, the hot cracking catalyst particles catalytically crack relatively large hydrocarbon molecules, which include those that were present in the original hydrocarbon feedstock and/or oxidized by reaction with the gaseous oxidant, by carbon-carbon bond cleavage. In addition, the hydrocarbon feedstock and cracked product fragments are contacted with gaseous oxidant, and organosulfur components of the original feedstock and/or organosulfur cracked products fragments are converted into oxidized organosulfur compounds. The oxidized portions of these organosulfur compounds are then cleaved to form sulfur oxides, mainly sulfur dioxide, by breaking the C—S bonds as shown in FIG. 2A and/or FIG. 2B. The overall reaction scheme is shown in FIG. 3.

The operating temperature and residence time in the riser 112 and reaction zone 114 can vary based on the characteristics of the feedstock, cracking and/or oxidation catalyst selection, or other factors. The operating conditions for catalytic cracking are suitable for avoidance of thermal conversion of compounds in the hydrocarbon feedstock. In certain embodiments in operation of a conventional FCC unit, the operating conditions include: a reaction temperature in the range of from about 400° C. to about 565° C.; in certain embodiments about 480° C. to about 550° C.; and in further embodiments about 510° C. to about 540° C.; a residence time in the range of from about 1 second to about 60 seconds; in certain embodiments about 1 second to about 10 seconds, and in further embodiments about 2 seconds to about 5 seconds; and an operating pressure in the range of from about 1 bar to about 30 bars; in certain embodiments about 1 bar to about 10 bars, and in further embodiments about 1 to about 3 bars. In embodiments of a high-severity FCC unit, the operating conditions include: a reaction temperature in the range of from about 500° C. to about 650° C.; in certain embodiments about 550° C. to about 635° C.; and in further embodiments about 590° C. to about 620° C.; a residence time in the range of from about 0.1 seconds to about 5 seconds; in certain embodiments about 0.1 seconds to about 2 seconds, and in further embodiments about 0.2 seconds to about 0.7 seconds; and an operating pressure in the range of from about 1 bar to about 30 bars; in certain embodiments about 1 bar to about 10 bars, and in further embodiments about 1 bar to about 3 bars.

During the reaction, as is conventional in FCC operations, the cracking catalysts become coked and hence access to the active catalytic sites is limited or nonexistent. Reaction products are separated from the coked catalyst using any suitable configuration known in FCC units, generally referred to as the separation zone 116 in FCC unit 100, for instance, located at the top of the reactor 110 above the reaction zone 114. The separation zone can include any suitable apparatus known to those of ordinary skill in the art such as, for example, cyclones.

The reaction product including the cracked hydrocarbons and sulfur dioxide, along with unreacted gaseous oxidant, is withdrawn through conduit 124. The sulfur dioxide and unreacted oxidant can be separated prior to recovery and/or further downstream processing of the cracked products. Accordingly, the recovered product is both desulfurized and cracked. For instance, in certain embodiments, up to about 20 W % of the original sulfur content is removed; in additional embodiments, up to 40 W % of the original sulfur content is removed; and in further embodiments, up to 50 W % of the original sulfur content is removed.

Catalyst particles containing coke deposits from oxidative fluid cracking of the hydrocarbon feedstock pass from the separation zone 114 through a conduit 126 to regeneration zone 118. In regeneration zone 118, the coked catalyst comes into contact with a stream of oxygen-containing gas, e.g., pure oxygen or air, which enters regeneration zone 118 via a conduit 128. The regeneration zone 118 is operated in a configuration and under conditions that are known in typical FCC operations. For instance, regeneration zone 118 can operate as a fluidized bed to produce regeneration off-gas comprising combustion products which is discharged through a conduit 130. The hot regenerated catalyst is transferred from regeneration zone 118 through conduit 122 to the bottom portion of the riser 112 for admixture with the hydrocarbon feedstock and noted above.

The temperature in regeneration zone 118 is maintained at a sufficiently high temperature to burn off the accumulated coke on the cracking catalyst and also to heat the catalyst to a level to transfer thermal energy to the hydrocarbon feed entering the riser 112 to the desired reaction temperature.

In addition, the pressure in regeneration zone 118 is at a level suitable to promote burning off of the accumulated coke on the cracking catalyst.

The catalyst is maintained in regeneration zone 118 for a residence time sufficient to burn off the accumulated coke on the cracking catalyst. For instance, in certain embodiments, a suitable residence time in regeneration zone 118 is in the range of from about 1 second to about 1 hour; in additional embodiments, about 1 second to about 2 minutes; and in further embodiments, about 1 second to about 1 minute.

A slipstream of unregenerated catalyst, i.e., catalyst containing coke deposits, can be passed from the reaction zone 114 to the riser 112 via a conduit 132. The recycled unregenerated catalyst to the reactor riser is to supply additional catalyst and/or to supply additional heat for reactions starting in riser 112. Unregenerated catalyst will always be a source of heat, and in certain oxidative fluid cracking processes in which low levels of coke deposits accumulate for each pass of catalyst, this slipstream 132 can serve as a supplemental source of active catalyst. Any quantity of catalyst contained in slipstream 132 is included in any consideration or calculation of the catalyst to oil ratio.

The hydrocarbon feedstock can be any suitable hydrocarbon mixture that can benefit from the integrated cracking and oxidative desulfurization operations described herein. For instance, the hydrocarbon feedstock can include but is not limited to vacuum gas oil, atmospheric residues, high hydrogen content feedstocks, reduced crude, demetalized oil, whole crude, cracked shale oil, liquefied coal, cracked bitumens, heavy coker gas oils, FCC heavy products such as LCO, HCO and CSO, and combinations comprising at least one of the foregoing, e.g., in a heavy oil pool. The system and process of the present invention is particularly suitable for a vacuum gas oil fraction having a boiling range from about 300° C. to about 565° C.

The catalytic cracking catalyst can be any suitable cracking catalyst that does not interfere with the contemporaneous oxidation reactions. In certain embodiments, the cracking catalyst is a solid zeolitic catalyst, such as a zeolitic matrix. Suitable dimensions and shapes for the cracking catalyst will be apparent to those of ordinary skill in the art. For instance, useful catalyst particles can be less than 200 microns in nominal diameter.

The weight ratio of cracking catalyst to hydrocarbon feedstock can be any suitable ratio that is sufficient to produce the desired reaction products and does not interfere with the contemporaneous oxidation reactions. For instance, in embodiments using a conventional FCC unit, suitable cracking catalyst to hydrocarbon feedstock weight ratios are in the range of from about 1:1 to about 15:1; in certain embodiments about 1:1 to about 10:1; and in further embodiments about 1:1 to about 6:1 In embodiments using a high-severity FCC unit, suitable cracking catalyst to hydrocarbon feedstock weight ratios are in the range of from about 1:1 to about 40:1, in certain embodiments about 1:1 to about 30:1, and in further embodiments about 10:1 to about 20:1.

The gaseous oxidant supplied via inlet 120 can be any suitable oxidant source, including but not limited to pure oxygen, a mixture containing oxygen, air, nitrous oxide and/or combination thereof. Note that although gaseous oxidant and the feedstock are illustrated as a single feed, they can optionally be combined as a separate feeds. A molar ratio of oxidant (available oxygen atoms) to sulfur compounds present in the feedstock can be in the range of from about 1:5 to about 1:500 mol:mol, in certain embodiments about 1:5 to about 1:30 mol:mol and in further embodiments about 1:5 to about 1:10 mol:mol.

Suitable oxidation catalysts are solid metals introduced as heterogeneous catalysts, including compounds containing cobalt, tungsten, nickel, vanadium, molybdenum, platinum, palladium, copper, iron, titanium, manganese, magnesium, zinc, cerium or a mixture of compounds thereof. In certain embodiments, particularly effective oxidation catalysts include compounds containing vanadium, molybdenum, chromium, or a mixture of compounds thereof.

In addition, suitable catalysts can be homogeneous catalysts, for instance, introduced with the oil solution, such as oxides and/or organo metal complexes of copper, zinc, cerium, cobalt, tungsten, nickel, vanadium, molybdenum, platinum, palladium, iron and mixtures thereof.

Heterogeneous oxidation catalyst can be introduced in various proportions, and in certain embodiments, may not be required at all. For instance, suitable quantities of heterogeneous oxidation catalyst based on the quantity of cracking catalyst can be in the range of from about 0 W % to about 100 W %, in certain embodiments about 10 W % to about 50 W % and in further embodiments about 20 W % to about 30 W %.

Homogeneous oxidation catalyst can be introduced in various proportions, and in certain embodiments, may not be required at all. For instance, suitable quantities of homogenous oxidation catalyst based on the feedstock mass flow rate can be in the range of from about 0 W % to about 30 W %, in certain embodiments about 0.1 W % to about 10 W % and in further embodiments about 1 W % to about 5 W %.

With the process integration of the present invention, the existing equipment in operations may be used to desulfurize the hydrocarbon feedstock in a cost effective way during existing cracking operations.

Accordingly, the present invention achieves the objects of providing an integrated desulfurization and deasphalting system process that can be practiced without the requirement to substantially modify existing facilities by adding costly equipment, hardware and control systems. Furthermore, the reaction product that is withdrawn from the FCC reactor for recovery and/or further processing has a reduced concentration of organosulfur compounds, and hence a lesser chemical and physicochemical impact on existing processes.

Unit operations commonly found in existing refineries are advantageously combined and employed in a manner that that achieves desulfurization and fluid catalyst cracking with an increase in efficacy and efficiency. In addition, operating conditions in the FCC unit are selected to optimize cleavage of C—C bonds associated with FCC reactions, and also C—S bond associated with oxidative desulfurization reactions that occur due to the presence of gaseous oxidant. Gas phase oxidative desulfurization conditions include a temperature in the range of from about 470° C. to about 580° C.; a pressure of about 1 kg/cm$^2$; and a residence time in the range of from about 2 seconds to about 6 seconds. These conditions fall within various embodiments of the FCC reaction conditions described above.

Furthermore, unlike conventional oxidative desulfurization processes that must use separate unit operations to extract sulfur by-products, heteroatomic sulfur is converted to sulfur dioxide, which is readily separated from the cracking reaction products by the system and method of the present invention uses the deasphalting zone to perform this requisite step.

The method and system of the present invention have been described above and in the attached drawings; however, modifications will be apparent to those of ordinary skill in the art and the scope of protection for the invention is to be defined by the claims that follow.

What is claimed is:

1. A process for catalytically cracking and oxidatively desulfurizing a hydrocarbon feedstock containing organosulfur compounds to thereby recover a product stream including lower boiling hydrocarbon components and having a reduced concentration of organosulfur compounds as compared to the hydrocarbon feedstock, the process comprising the steps of:

a. combining the hydrocarbon feedstock, an effective amount of oxygen containing gas, an effective amount of heated cracking catalyst and optionally an effective amount of heterogeneous catalyst containing oxidation functionality to form a suspension;

b. maintaining the suspension through a reaction zone of a fluid catalytic cracking reactor apparatus to;

oxidize at least a portion of organosulfur compounds in the hydrocarbon feedstock to form oxidized organosulfur compounds, cleave carbon-sulfur bonds of oxidized organosulfur compounds to form sulfur-free hydrocarbon compounds and sulfur oxide, and catalytically crack oxidized and unoxidized compounds, including unoxidized sulfur-free hydrocarbon compounds, unoxidized organosulfur compounds, and oxidized organosulfur compounds, into hydrocarbon compounds of lower boiling points, wherein catalytic cracking occurs under conditions that favor catalytic cracking over thermal cracking of compounds in the hydrocarbon feedstock;

c. separating and recovering cracked components and the cracking catalyst particles;

d. regenerating at least a portion of the separated cracking catalyst particles; and e. returning at least a portion of the regenerated cracking catalyst particles with the hydrocarbon feedstock and oxygen containing gas in step (a).

2. The process of claim 1, wherein step (a) further comprises adding an effective quantity of heterogeneous catalyst containing oxidation functionality.

3. The process of claim 1 or 2, further comprising adding an effective quantity of homogeneous catalyst containing oxidation functionality to the feedstock upstream of step (a).

4. The process of claim 3, wherein the homogenous catalyst is in the range of up to about 30 weight % of the hydrocarbon feedstock.

5. The process of claim 1, wherein the reaction zone is operated at a temperature in the range of from about 400° C. to about 565° C.

6. The process of claim 5, wherein the reaction zone is operated at a residence time in the range of from about 1 second to about 60 seconds.

7. The process of claim 1, wherein the reaction zone is operated at a temperature in the range of from about 500° C. to about 650° C.

8. The process of claim 7, wherein the reaction zone is operated at a residence time in the range of from about 0.1 second to about 5 seconds.

9. The process of claim 1, wherein the recovered cracked components have a sulfur reduction of up to 50 weight %.

10. The process of claim 1, wherein the weight ratio of cracking catalyst to hydrocarbon feedstock is in the range of from 1:1 to 40:1.

11. The process of claim 1, wherein the weight ratio of cracking catalyst to hydrocarbon feedstock is in the range of from 1:1 to 15:1.

12. The process of claim 1, wherein the molar ratio of oxygen in the oxygen containing gas to sulfur compounds present in the hydrocarbon feedstock is in the range of from 1:5 to 1:500.

13. The process of claim 1, wherein the heterogeneous catalyst is in the range of from about 0 weight % to about 100 weight % of the cracking catalyst.

* * * * *